United States Patent [19]

Harada

[11] 4,156,829

[45] May 29, 1979

[54] APPARATUS FOR SUPPRESSING RADIATION LEAKAGE IN A MAGNETRON CIRCUIT

[75] Inventor: Akikazu Harada, Mobara, Japan

[73] Assignee: Hitachi, Ltd., Tokyo, Japan

[21] Appl. No.: 833,910

[22] Filed: Sep. 16, 1977

[30] Foreign Application Priority Data

Sep. 16, 1976 [JP] Japan ..... 51-109976

[51] Int. Cl.[2] ..... H01J 25/50

[52] U.S. Cl. ..... 315/39.51; 219/10.55 B; 219/10.55 D; 313/239; 313/313; 315/85; 315/101; 315/105

[58] Field of Search ..... 315/39.51, 85, 94, 101, 315/103, 105; 219/10.55 D, 10.55 B; 313/239, 313

[56] References Cited

U.S. PATENT DOCUMENTS

| | | | |
|---|---|---|---|
| 3,304,400 | 2/1967 | Ojelid | 219/10.55 B |
| 3,651,371 | 3/1972 | Tingley | 315/102 |
| 3,924,196 | 12/1975 | Takahashi et al. | 315/39.51 |

*Primary Examiner*—Saxfield Chatmon, Jr.
*Attorney, Agent, or Firm*—Charles E. Pfund

[57] ABSTRACT

The magnetron apparatus comprises a magnetron tube and a driving circuit including a transformer having a primary winding, a low voltage secondary winding for energizing the cathode filament of the magnetron tube and a high voltage secondary winding for applying an anode voltage upon the anode electrode of the tube. The high and low secondary windings and the terminals of the cathode filament are contained in a shield casing for preventing leakage of the wave.

5 Claims, 6 Drawing Figures

APPARATUS FOR SUPPRESSING RADIATION LEAKAGE IN A MAGNETRON CIRCUIT

BACKGROUND OF THE INVENTION

This invention relates to magnetron apparatus comprising a magnetron tube and a circuit for driving the same, and more particularly an improved magnetron construction capable of preventing leakage of undesired high frequency wave from the power input of the magnetron.

In a microwave oven or the like utilizing magnetron apparatus, high frequency energy is generally used so that it is important to prevent leakage of the electromagnetic wave which affects television and radio receiver sets. More particularly, as will be described later in detail with reference to the accompanying drawings, a portion of the high frequency energy created in the interaction space of the magnetron tube during the operation thereof is captured by the cathode filament located in the interaction space and it leaks to the outside of the tube through filament lead wires. Since such leaked wave interferes with the operation of various communication devices, it is necessary to prevent such leakage. To accomplish this, in one example of the prior art magnetron, a metal shield is mounted on a magnetron tube so as to surround the cathode filament terminals of the magnetron tube and a wave leakage prevention filter comprising a coil and a serially connected feed-through capacitor is connected between the filament terminals and lead wires led from the shield casing and extending to an external source.

However, since the operating voltage of the feed-through capacitor is a high voltage which is substantially equal to the anode voltage of the magnetron tube, it is necessary for the feed-through capacitor to withstand against such a high voltage and hence the feed-through capacitor is expensive. Due to a limit on the size of the coil and feed-through capacitor and the insulating strength required for the feed-through capacitor, the cut-off frequency of the filter becomes to about several MHz so that the filter is not effective to prevent leakage of the waves having a frequency less than this frequency.

SUMMARY OF THE INVENTION

Accordingly, it is an object of this invention to provide a novel magnetron apparatus capable of efficiently preventing leakage of high frequency wave over a wide frequency band without using any filter for preventing the leakage of the wave.

According to this invention, there is provided magnetron apparatus of the type comprising a magnetron tube including a cylindrical anode and a cathode structure disposed in an interaction space and extending in the axial direction of the anode, the cathode structure being provided with a cathode filament and filament terminals, and a driving circuit including a transformer having a primary winding adapted to be connected to a source of alternating current, a low voltage secondary winding connected across the filament terminals and a high voltage secondary winding for supplying an anode voltage to the anode electrode, wherein a shield casing is provided for surrounding the high and low voltage secondary windings and the filament terminals.

DESCRIPTION OF THE PREFERRED EMBODIMENTS

Figure 1:
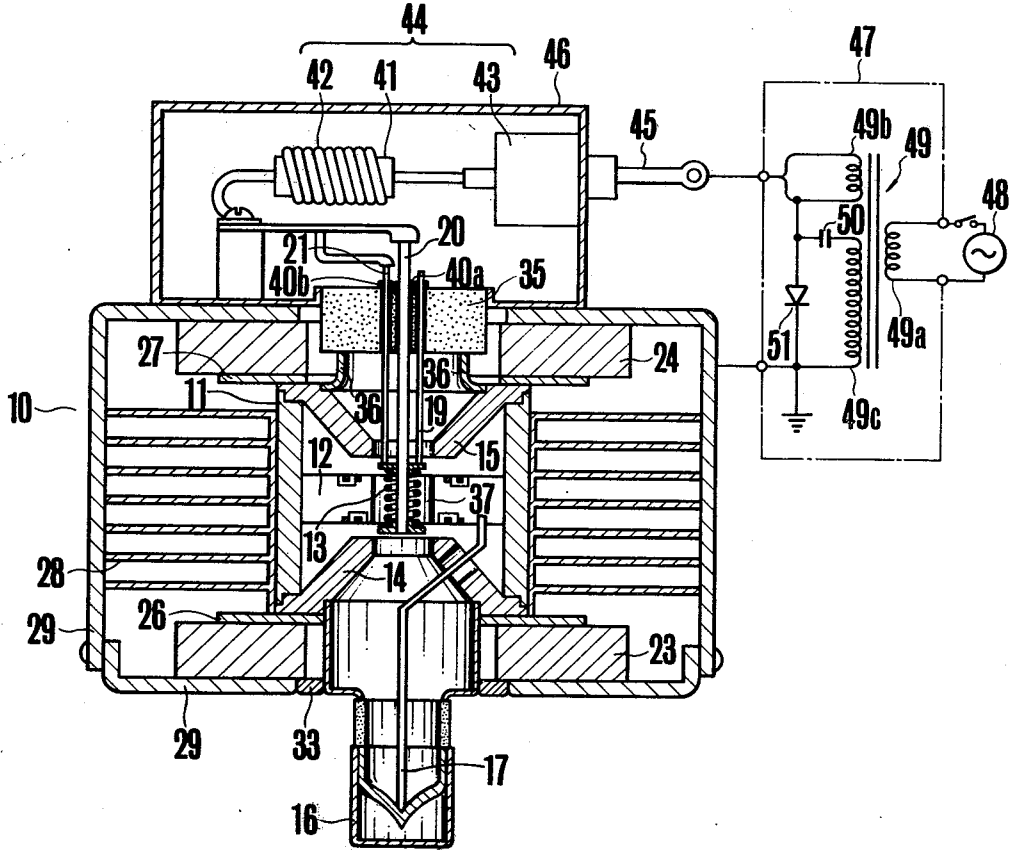
FIG. 1 PRIOR ART
FIG. 1 shows a longitudinal sectional view and an electrical connection of one example of a prior art magnetron apparatus.

One example of the prior art magnetron apparatus will firstly be described with reference to FIG. 1 in which a magnetron tube 10 comprises an anode cylinder 11 provided with a plurality of radial vanes 12 secured to the inner wall thereof. At the center of the anode cylinder 11 is disposed a cathode structure 13. Frustum shaped pole pieces 14 and 15 are disposed on the opposite ends of the anode cylinder. An antenna 17 extends through the pole piece 14 between the space in which the vanes 12 are located and an output terminal 16 and three lead conductors 19, 20 and 21 connected to the cathode structure 13 extend upwardly through the center of the other pole piece 15. Permanent magnets 23 and 24 are disposed close to the pole pieces 14 and 15 respectively and flux focusing rings 26 and 27 are disposed between the permanent magnet 23 and the pole piece 14 and between the permanent magnet 24 and the pole piece 15. A plurality of heat radiating fins 28 are provided to surround the anode cylinder 11 and the component parts described above are contained in an iron casing 29.

A gasket 33 is mounted on the inner periphery of the casing 29 and a stem 35 is provided at the top center of the casing 29 for supporting the lead conductors 19, 20 and 21. A support 36 for supporting the stem 35 is also mounted on the magnetic pole piece 15. The vanes 12 and the cathode structure 13 define an interaction space 37. The magnetic flux created in the interaction space by the permanent magnets 23 and 24 impacts rotary motion to the electrons emanated from the cathode structure and accelerated by the anode voltage, and the electromagnetic wave thus produced is radiated into the oven of a microwave oven, not shown, via the antenna 17 and output terminal 16.

The extensions of the lead wires are led out to the outside of the tube from the filament terminals $40_a$ and $40_b$ and are wound about a ferrite core 41 to form a choke coil 42 which in turn is connected in series with a feed-through capacitor 43 to form a filter 44 for preventing leakage of the high frequency wave. The other end of the filter 44 is connected to a lead wire 45 and the filter is entirely surrounded by a metal shield casing 46. Since a filter associated with the lead wire 21 is disposed in a direction perpendicular to the sheet of the drawing, it is not shown in FIG. 1.

The magnetron driving circuit shown by a dot and dash line block 47 comprises a transformer 49 having a primary winding $49_a$ adapted to be connected to an AC source 48 via a switch, a low voltage secondary winding $49_b$ and a high voltage secondary winding $49_c$. The low voltage secondary winding $49_b$ applies an AC filament voltage of 3.15 volts, for example, across filament lead wires 20 and 21 via lead wire 45. Across the high voltage secondary winding $49_c$ is connected a series circuit including a capacitor 50 and a diode 51. The juncture between the anode electrode of the diode and the capacitor is connected to one end of the low voltage secondary winding, whereas the juncture between the cathode electrode of the diode 51 and one end of the high voltage secondary winding $49_c$ is connected to the ground and the casing 29 of the magnetron tube. The capacitor 50 and the diode 51 constitute a voltage doubling rectifier circuit thus producing a rectified voltage of 4 KV, for example. Consequently −4 KV is applied to the cathode electrode of the magnetron tube with respect to the grounded anode. Depending upon the type of the magnetron, the AC voltage induced in the high voltage secondary winding is applied directly upon the anode of magnetron without rectification.

During the operation of the magnetron apparatus, since the cathode electrode 13 is subjected to an extremely strong high frequency field, a portion of the high frequency energy generated is captured by the cathode electrode 13, thus causing leakage of the electromagnetic wave. The filter 44 described above is provided for the purpose of preventing such leakage, but since a high voltage of about 4 KV is impressed across the feed-through capacitor 43 that constitutes a portion of the filter 44 and the shield casing 46, the feed-through capacitor must have a high insulating strength so that it is expensive. Moreover, since the filter 44 constituted by the feed-through capacitor 43 and the coil 42 should be compact and has a large insulating strength, it is usual to use a feed-through capacitor having a capacity of 500 to 1000 PF and a choke coil having an inductance of about several $\mu$H. Consequently, the cut-off frequency of the filter is about several MHz so that the filter is not effective to prevent leakage of electro-magnetic waves having frequencies lower than the cut-off frequency.

One embodiment of this invention will now be described with reference to FIGS. 2A and 2B. The invention is applicable to the magnetron tube 10 shown in FIG. 1 without any change, so that in FIG. 2A it is shown diagrammatically, and in FIG. 2B which shows the electric connection, the magnetron tube is shown as a diode tube. In FIGS. 2A and 2B, elements corresponding to those shown in FIG. 1 are designated by the same reference numerals.

As shown in FIG. 2A, a relatively large metal shield casing 60, fabricated by a steel plate of a thickness of preferably 0.2 to 0.5 mm, is secured to one side of the magnetron tube 10 to which the stem 35 is secured to surround filament terminals $40_a$ and $40_b$. On the inside of this casing is positioned only the secondary windings of the transformer 49 of the magnetron driving circuit 47 and its low voltage secondary winding $49_b$ is connected across the filament terminals $40_a$ and $40_b$. One terminal of the high voltage secondary winding $49_c$ is grounded via a bolt $61_b$ and the shield casing 60 whereas the other terminal is connected to the filament terminal $40_b$ via a capacitor 50 and to the anode electrode of a rectifier 51 with its cathode electrode connected to the anode electrode of the magnetron tube 10 and the shield casing 60. The capacitor 50, the rectifier 51, and the high and low voltage secondary windings $49_c$ and $49_b$ are contained in the grounded shield casing 60. On the other hand, the primary winding $49_a$ of the transformer 49 is located on the outside of the shield casing 60. The core $49_d$ is secured to the shield casing 60 by bolts $61_a$ and $61_b$.

With this construction, the primary side and the secondary side of the transformer 49 are electrostatically shielded from each other. Thus, the shield casing 60 acts as a filter casing that prevents leakage of the high frequency energy induced in the secondary side of the transformer to the outside of the casing and the primary winding $49_a$.

Although a portion of the electromagnetic wave couples to the primary winding $49_a$ via the magnetic flux flowing through the core $49_d$ by constructing the core with material having a frequency response less than several ten KHz, not only the permeability of the core decreases greatly for frequencies above this response frequency but also the core acts as a loss material. Accordingly, a large attenuation is provided for the interfering wave having frequencies in a frequency band above several ten KHz including television and radio frequency bands.

Figure 4A:
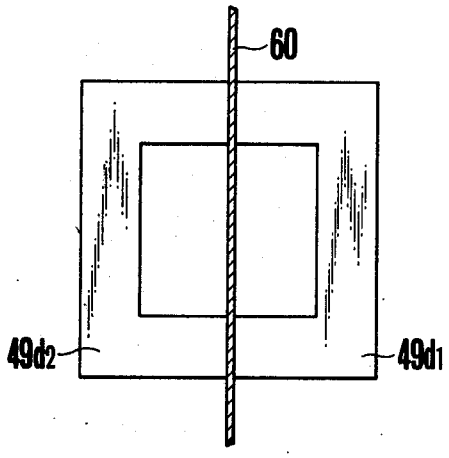
FIGS. 4A and 4B are diagrams showing different manners of mounting transformer cores.

As shown in FIG. 4A, the transformer core $49_d$ is divided into primary and secondary sections $49_{d1}$ and $49_{d2}$, and by clamping the side wall of the casing 60 between these sections, it is possible to prevent extremely short waves such as microwaves in the secondary circuit from leaking to the primary side. Thus, it is possible to effectively shield interference waves ranging from several ten KHz to higher harmonics thereof, that is waves on the lower and higher frequency sides of fundamental frequency of the microwave.

FIG. 2B shows a connection diagram of the magnetron apparatus shown in FIG. 2A. As shown, the secondary side core, and the secondary windings of the transformer, and the voltage doubling rectifier circuit are contained in the shield casing 60 shown by dotted lines.

Figure 2A:
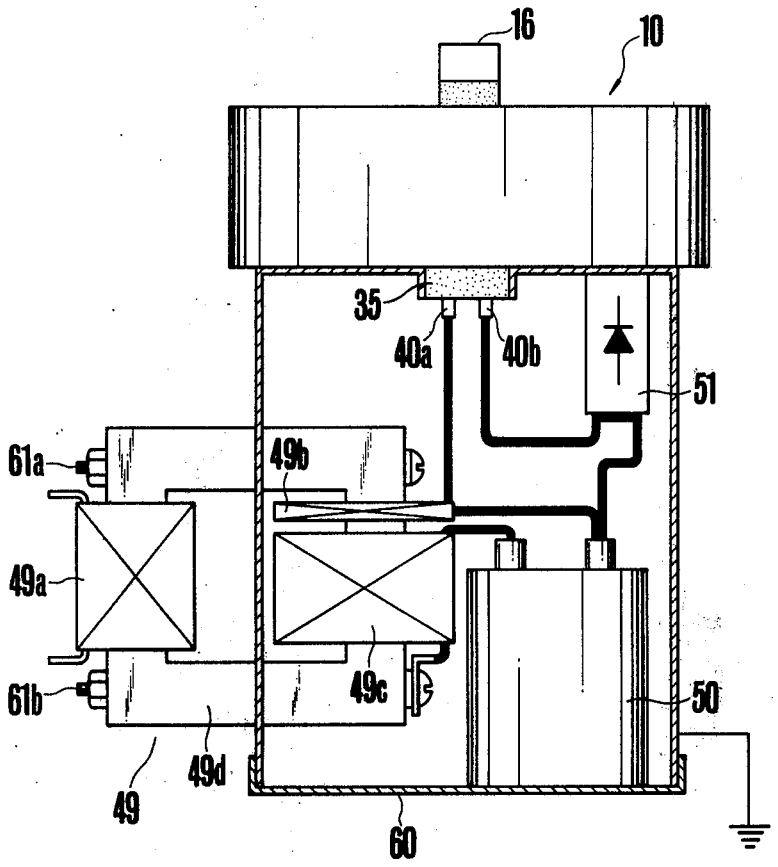
FIG. 2A is a diagrammatic representation, partly in section, showing one example of the magnetron apparatus embodying the invention.
Figure 2B:
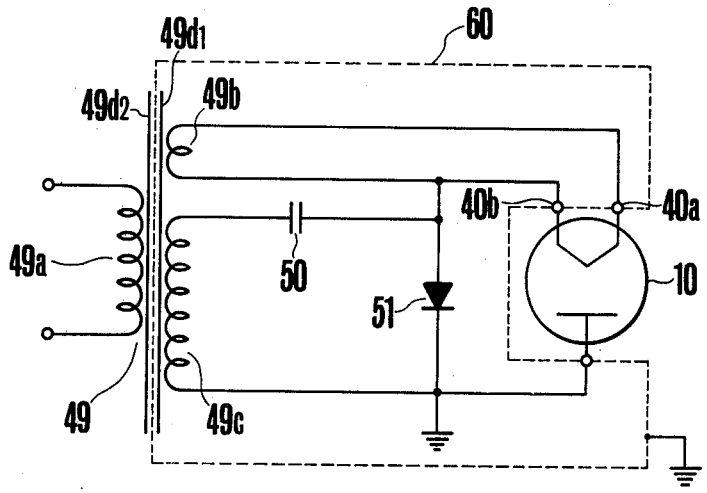
FIG. 2B is a connection diagram of the magnetron apparatus shown in FIG. 2A.
Figure 3:
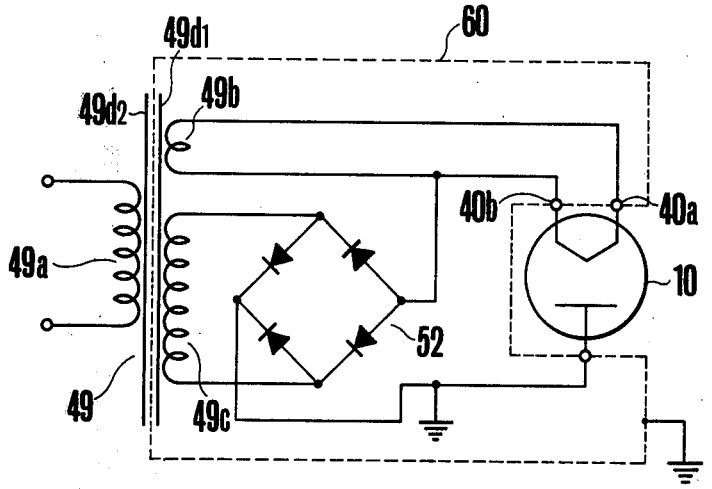
FIG. 3 is a connection diagram showing a modified embodiment of this invention.

FIG. 3 shows a modified embodiment of this invention in which elements corresponding to those shown in FIGS. 1, 2A and 2B are designated by the same reference numerals. The circuit shown in FIG. 3 is similar to that shown in FIG. 2B except that the voltage doubling capacitor 50 is omitted and that a full-wave rectifier circuit 52 is connected to one terminal of the low voltage secondary winding and across the high voltage secondary winding.

It will be clear that the invention is also applicable to a magnetron in which the anode electrode is driven by alternating current.

Figure 4B:
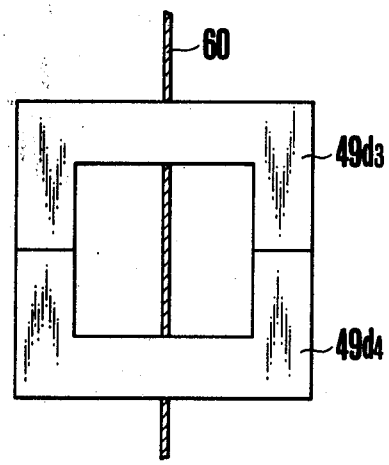

FIG. 4B shows a modified method of mounting the transformer core on the shield casing 60. In this case, the core is divided into upper and lower sections $49_{d3}$ and $49_{d4}$ which are mounted on the side wall of the shield casing through openings.

As above described, according to this invention, the secondary windings of transformer and rectifier circuit of the magnetron driving circuits are contained in a shield casing it is possible to positively prevent leakage of the electromagnetic wave over a wide frequency range.

What is claimed is:

1. In a magnetron apparatus of the type comprising a magnetron tube including a cylindrical anode, and a cathode structure disposed in an interaction space and extending in the axial direction of said anode, said cathode structure being provided with a cathode filament and filament terminals, and a driving circuit including a transformer having a primary winding adapted to be connected to a source of alternating current, a low voltage secondary winding connected across said filament terminals and a high voltage secondary winding for supplying anode voltage to said anode electrode, the improvement which comprises a shield casing surrounding said low voltage secondary winding, said high voltage secondary winding and said filament terminals and not surrounding said primary winding, so as to electrostatically isolate said primary winding from said secondary windings.

2. The magnetron apparatus according to claim 1 which further comprises a rectifier circuit connected to one terminal of said low voltage secondary winding and across said high voltage secondary winding and contained in said shield casing.

3. The magnetron apparatus according to claim 1 wherein said transformer further comprises a magnetic core which is divided into two sections and a side wall of said shield casing is clamped between said two sections.

4. The magnetron apparatus according to claim 1 wherein said transformer further comprises a magnetic core extending through a side wall of said shield casing.

5. The magnetron apparatus according to claim 1 wherein said transformer includes a magnetic core composed of a material having a frequency response less than several tens of kilohertz so as to attenuate signals having frequencies above the frequency response of the core material to reduce signals electromagnetically coupled from the secondary windings to the primary windings.

* * * * *